US009775198B2

(12) United States Patent
Venter

(10) Patent No.: US 9,775,198 B2
(45) Date of Patent: Sep. 26, 2017

(54) ELECTRODE CLAMPING DEVICE

(71) Applicant: Jacques Venter, Rivonia (ZA)

(72) Inventor: Jacques Venter, Rivonia (ZA)

( * ) Notice: Subject to any disclaimer, the term of this patent is extended or adjusted under 35 U.S.C. 154(b) by 44 days.

(21) Appl. No.: 14/410,967

(22) PCT Filed: Jun. 24, 2013

(86) PCT No.: PCT/IB2013/055166

§ 371 (c)(1),
(2) Date: Dec. 23, 2014

(87) PCT Pub. No.: WO2014/001991

PCT Pub. Date: Jan. 3, 2014

(65) Prior Publication Data

US 2015/0173131 A1 Jun. 18, 2015

(30) Foreign Application Priority Data

Jun. 28, 2012 (ZA) ..... 2012/04814

(51) Int. Cl.
*H05B 7/10* (2006.01)
*F27B 3/08* (2006.01)
(Continued)

(52) U.S. Cl.
CPC ..... *H05B 7/10* (2013.01); *F27B 3/085* (2013.01); *F27D 11/10* (2013.01); *H05B 7/11* (2013.01)

(58) Field of Classification Search
CPC .. F27B 3/085; H05B 7/06; H05B 7/08; H05B 7/10; H05B 7/11; H05B 7/12; H05B 7/14;
(Continued)

(56) References Cited

U.S. PATENT DOCUMENTS 2,587,045 A * 2/1952 Hogel ..... H05B 7/103 373/99
2,668,183 A * 2/1954 Foyn ..... H05B 7/103 373/100
(Continued)

FOREIGN PATENT DOCUMENTS

CN 201550314 U 8/2010
DE 3443574 A1 5/1986
(Continued)

OTHER PUBLICATIONS

International Search Report mailed May 21, 2014 (PCT/IB2013/055166); ISA/EP.
(Continued)

*Primary Examiner* — Hung D Nguyen
(74) *Attorney, Agent, or Firm* — Banner & Witcoff, Ltd.

(57) ABSTRACT

An electrode clamping device is suitable for use in an electrical arc furnace. The clamping device is used releasably to clamp an electrode of an electric arc furnace, and includes at least one elongate tension element configured in use to extend at least partially about a periphery of the electrode of the arc furnace in order for the tension element to define a tensionable loop about the electrode that is adapted to exert a clamping force on the electrode when tensioned. The clamping device also includes a tensioning mechanism including tensioning means adapted to exert a tensile force on end zones of the clamping element so as to tension the tension element, characterized in that the force exerted by the tensioning means is directed in a radial direction relative to the electrode.

12 Claims, 4 Drawing Sheets

(51) Int. Cl.
*F27D 11/10* (2006.01)
*H05B 7/11* (2006.01)

(58) Field of Classification Search
CPC ..... H05B 7/101; H05B 7/103; H05B 7/085; H05B 7/105; H05B 7/107; H05B 7/102; H05B 7/109; H05B 7/156; F27D 11/10
USPC ..... 373/69, 89, 94, 95, 97, 99, 100, 101
See application file for complete search history.

(56) References Cited

U.S. PATENT DOCUMENTS 2,753,388 A * 7/1956 Bjerkas ..... H05B 7/10 373/94
2,899,477 A * 8/1959 Cartoux ..... B25J 15/00 373/101
3,937,867 A * 2/1976 Wynne ..... H05B 7/14 373/92
4,653,066 A 3/1987 Phillips
2008/0247440 A1 * 10/2008 Artman ..... H05B 7/085 373/88

FOREIGN PATENT DOCUMENTS

| | | | |
|---|---|---|---|
| EP | 1432291 | A1 | 6/2004 |
| RO | 96661 | B | 3/1991 |
| SU | 944166 | A1 | 7/1982 |
| SU | 1072294 | A1 | 2/1984 |
| WO | 2011063426 | A1 | 5/2011 |
| WO | 2011110522 | A1 | 9/2011 |

OTHER PUBLICATIONS

Apr. 19, 2017—(RU) Office Action—App 2015102654/02(004115)—Eng Tran.

* cited by examiner

ELECTRODE CLAMPING DEVICE

BACKGROUND TO THE INVENTION

The invention relates to an electrode clamping device suitable for use in an electrical arc furnace.

Arc furnaces are frequently used in the steel and ferro alloy production industry during metallurgical smelting operations. An electric arc furnace comprises one or more electrodes that extend into a furnace. Lower ends of the electrodes are located adjacent a furnace load, and in use supplies the required energy to melt the load by forming an electric arc between the electrode and the furnace load. The electric current required to achieve the "arcing" is conducted to the electrode by way of conductive contact shoes, which provides a conductive path between the energy source and the electrodes.

Arc furnaces also include positioning systems which are designed to hold the electrodes, and also to control the position of the ends of the electrodes relative to the load so as to ensure that approximately constant current and power input are maintained during the melting or smelting of the load. The various positioning systems typically have the same common denominator of having a yoke that releasably engages the electrode, with the yoke being displaceable relative to the roof of the furnace so as to control the position of the electrode. The yoke is generally displaced by a winch or a hydraulic piston arrangement.

During operation the electrodes are consumed at lower ends thereof, and needs to be continuously displaced downwardly to ensure that terminal ends thereof remain proximate the furnace load. To some extent, the positioning system as described above is used to control the position of the end of the electrode. However, at a certain point the positioning system will reach an absolute lower limit, and the electrode will have to be readjusted relative to the electrode holder in order to allow further downward displacement of the electrode. In practice, this means the electrode must be allowed to be downwardly displaced relative to the electrode holder, and this process is generally referred to as electrode slipping. In some cases, for example where excessive slip has been allowed, there may be a need to displace the electrode upwardly relative to the electrode holder. This process is referred to as back slipping.

In most existing arc furnaces slipping is enabled by providing a set of two vertically adjacent clamping devices. The first clamping device is provided on the yoke, and the second clamping device is spaced from the first by means of hydraulic pistons. When slipping is required, one of the two clamping devices is released and moved away from the other that is still holding the electrode when in the desired position it reengages the electrode, at this point the other clamping device is released and the two is then moved closer to each other "slipping" the electrode downwardly, once the desired "slip" is reached both clamps may be reengaged to hold the electrode. It will be appreciated that there may be many different configurations through which the above methodology can be implemented. However, all the configurations share the common denominator of having two clamping devices, each of which is required to exert a clamping force on the electrode in a first, clamping condition, and in most cases to exert no clamping force or a reduced clamping force on the electrode in a second, release condition.

The slipping process has to be done in a very controlled manner due to the size, weight and sensitivity of the electrodes to breakages. In addition, an outer surface of an electrode generally has a relatively low coefficient of friction, which renders the proper clamping of an electrode, especially during slipping, critical. In smelters that utilize Soderberg electrodes of the smooth type the clamping is typically done at a level where the thin steel electrode casing or shell is the only source of structural support, and the clamping must therefore be done in manner that will not result in crushing of the thin casing or shell. In order to achieve this it is imperative for forces to be distributed evenly right around the electrode.

On large electrodes over about 800 mm in diameter, a number of different clamping device designs are known in industry, and from a functional design perspective they can generally be divided into two major groups. A first group of clamping device are all characterised in that the clamping force is applied in a radial direction at a number of discrete points of clamping right around the electrode. In a second group of clamping devices, the clamping force is generated circumferential about the entire periphery of the electrode like a wire hose clamp.

As mentioned above, in the first group the clamping force is applied radially, for example by arranging sets of springs around the electrode. The sets of springs then apply direct radial or near radial pressure on the electrode, typically from four or more sides. In this design the required clamping force is quite high, and is determined only by the mass of the electrode and the achieved friction coefficient between the holding shoes and the casing. For example, for an electrode of 40 ton having a friction coefficient of about 0.4, the required radial force would be about 100 ton, which must be divided between the number of clamping members if four segments then that will be 25 ton each. The reaction forces are taken up in a frame that surrounds the electrode and houses the force generating devices. This kind of device then also needs multiple de-clamping devices to remove the applied force, so if the force is applied from four directions then four de-clamping devices are also required because each force generating mechanism is a functionally discrete unit.

A first disadvantage of this type of clamping device is that where springs are used for the force generating device, the springs need to be preloaded by compressing the springs with a suitable adjustment mechanism. Considering that in the above example (four clamping points) the forces are applied in 90 degree segments then one would have to preload a 25 ton set of springs at each clamping point. This is not an easy task and can cause significant delays during setup and maintenance. A further disadvantage is that this kind of design is also very heavy, as it needs a structural frame, multiple de-clamping devices, and large and very heavy springs. The spring mechanism can also be very expensive and difficult to obtain, for example if cup springs are used which also have other disadvantages.

The second group of clamping device, as already mentioned above, is the family of clamping devices where an actuation force is distributed in a circumferential manner, but the corresponding clamping force is then exerted on the electrode in a radial direction. This is therefore effectively an arrangement where a clamping 'band' extending about the circumference of the electrode is tensioned. The term 'band' is of course used loosely, and should be interpreted to include a cable, chain, a plurality of linked elements, or any suitable elongate tensioning element that can be positioned about the periphery of the electrode, and which can transfer a tensile load.

The clamping force is applied by pulling at the ends of the band(s), and the direction of the applied tensioning force is therefore in all cases essentially tangential relative to the electrode. This force distribution about the periphery of the electrode results in a considerable reduction in the required actuation force, and for the same electrode mentioned in the example above the required actuation force reduces from 100 ton to about 20 ton. As a further advantage this kind typically only needs a single de-clamping device as only a single actuation force-generating device can be used. However this kind of clamping device needs some additional equipment to ensure that the circumferential force is distributed around the electrode. This can be by means of levers, hinges, flexible bands, linkages or cables. To achieve a symmetrical design the force needs to be applied through lever arms of some sort, which makes the force-generating device quite large, heavy and expensive. The lever arms also introduce additional maintenance requirements.

The use of the lever arms furthermore increases the required travel of the de-clamping device during de-clamping of the clamping device. Far example, in some cases a spring travel of 90 mm is required in order for the band to be slackened by 30 mm (lever arms of 3:1 ratio) which then gives less than 5 mm radial release on the electrode. This is not ideal, as the required spring displacement should be kept to a minimum. If no symmetry is needed the lever arms will not be required, but in such configuration the force-generating device protrudes quite far from the electrode, which may not be acceptable from a practical perspective.

An advantage of this type of clamping device is that typically no structural frame is needed for the force-generating device to act against. Furthermore, during setup and maintenance the de-clamping device can be used to compress the force-generating devices (springs) further, and adjustment is therefore done without needing to pre-stress the springs manually.

It is accordingly an object of the invention to provide an electrode clamping device that will at least partially, alleviate the above disadvantages.

It is also an object of the invention to provide an electrode clamping device which will be a useful alternative to existing electrode clamping devices.

It is a still further object of the invention to provide a clamping device suitable for use in electrode clamping and slipping assembly.

SUMMARY OF THE INVENTION

According to the invention there is provided a clamping device, suitable for clamping and holding an electrode of an arc furnace, the clamping device including at least one force-generating means that exerts a radial or near radial directed force relative to the electrode, and wherein a reactive force directed away from the electrode is taken up and distributed around the electrode by means of a circumferential tensioning member.

There is provided for the electrode to be a Soderberg type electrode but the design would also be suitable on other electrode types.

There is provided for the tensioning member to be a flexible or hingable tensioning member.

The tensioning member may be in the form of at least one elongate tension element configured in use to extend at least partially about a periphery of the electrode of the arc furnace in order for the tension element to define a tensionable loop about the electrode that is adapted to exert a clamping force on the electrode when tensioned.

In a preferred embodiment the force generating means may include at least one biasing means having a first end and a second end, wherein a first end of the biasing means is in use located adjacent the electrode, and wherein the second end is located radially or near radial outwardly of the first end.

There is provided for the end zones of the tensioning member to be secured relative to the second end of the biasing means in order for displacement of the second end of the biasing means to result in tensioning of the tensioning member.

There is also provided for end zones of the tensioning member to be angularly offset relative to the biasing means axis. This angle is preferably between 35 and 85 degrees, more preferably between 45 and 75 degrees, and most preferably about 60 degrees when in the preloaded clamping position.

At the most preferred angle of 60 degrees the optimum balance is reached between force magnitude transferred into the tension mechanism (cable) and the release movement. For example if the force from the biasing means is 220 kN then, then a 220 kN force will be exerted on each of the two tension members, at a very desirable ratio of 1:2. Furthermore, if the biasing means is de-clamped by only 50 mm then it causes more than 40 mm circumferential release, a ratio of almost 1:1, which is also very desirable.

The offset may be achieved by guiding the ends of the tensioning member around a guiding or anchoring formation so that the tensioning member may bend over it at a desired radius.

The guiding formation may be round.

The biasing means may be displaceable between an extended position and a compressed position, and may be biased towards the extended position.

The biasing means is preferably in the form of a spring, and more preferably in the form of a helical coil spring. There is also provided for the biasing means to be in the form of an actuator.

A further feature of the invention provide for the clamping device to include friction shoes, which are in use located between the tensioning member and the electrode casing surface. Alternatively the tensioning member may also be integrated into a friction shoe to form one integral part that is pivotally linked to an additional similar shoe or shoes.

There is provided for the tensioning member to comprise two separate tension elements, with one tension element provided on each side of the electrode, and with each tension element having a first end and a second end.

The first ends of the clamping elements may be secured to an adjustment arrangement where the effective length of each tensioning element, and therefore the loop formed by the clamping elements, can be adjusted.

The second ends of the tension elements may be secured to the force generating mechanism, and more particularly to the second end of the biasing means or spring.

The or each tension element may be in the form of a continuous flexible cable, band, linkage, chain or strap.

The or each tension element may be in the form of a plurality of essentially parallel and continuous flexible cables, bands, linkages or straps.

The or each tension element may alternatively include a number of interconnected, pivotable links.

A stilt further feature of the invention provides for the clamping device to include an optional de-clamping mechanism for use in reducing the tension in the clamping element(s) in order to release the clamped electrode.

The de-clamping device may include a piston and cylinder arrangement which is configured to compress the spring when actuated.

BRIEF DESCRIPTION OF THE DRAWINGS

A non-limiting example of the invention is described with reference to the accompanying figures, in which.

DETAIL DESCRIPTION OF THE INVENTION

Figure 1:
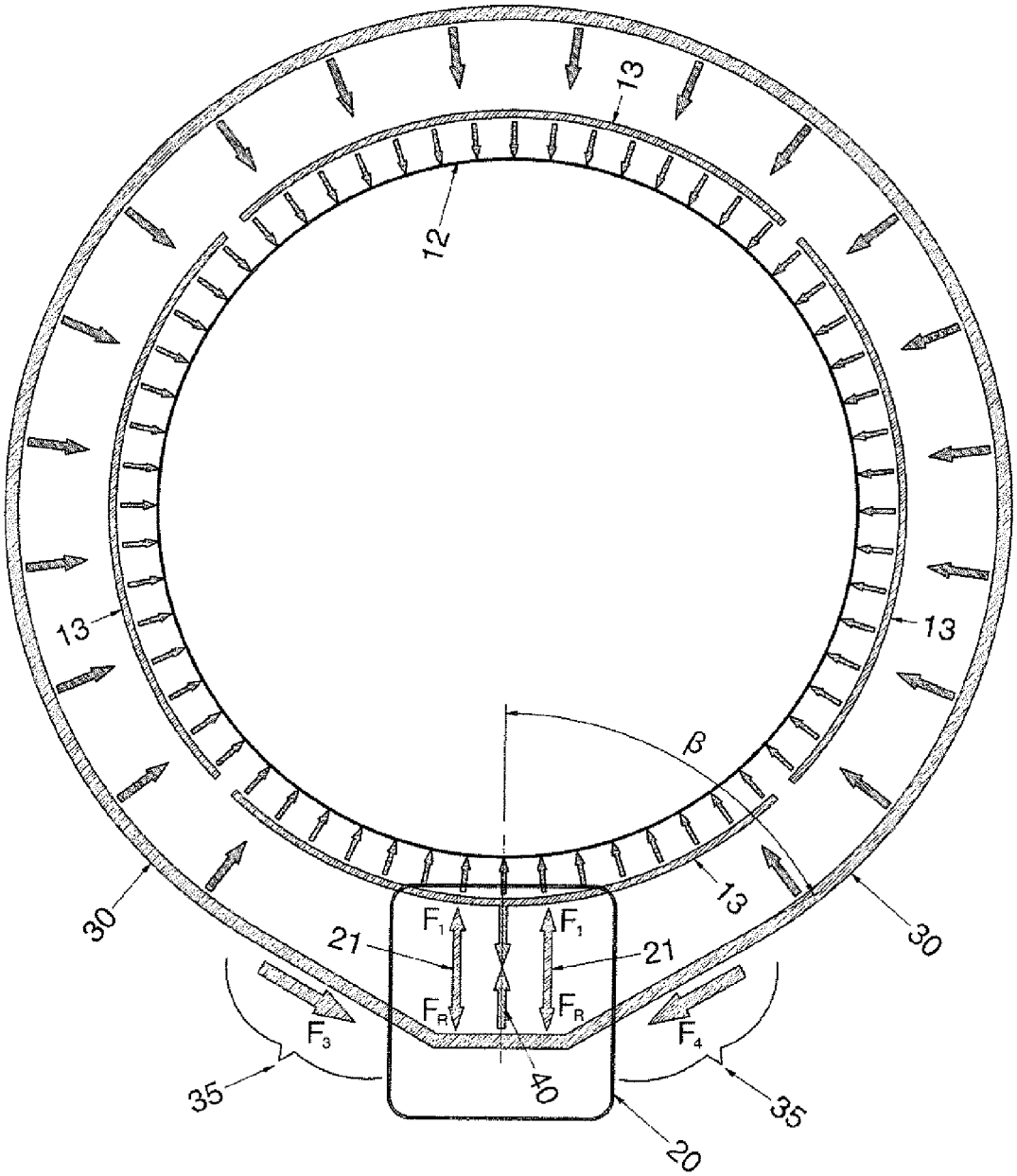
FIG. 1 is a schematic cross-sectional plan view of a clamping device in accordance with the invention, which illustrates the general concept embodied by the invention.

Referring to the figures, in which like numerals indicate like features, a non-limiting example of a clamping device in accordance with the invention is indicated by reference numeral 10.

The gist of the invention is described with reference to FIG. 1, which is a schematic representation of clamping device 10 in accordance with this invention. The clamping device 10 is used to clamp an electrode 11, most typically of the Soderberg type, and more particularly exerts a releasable clamping force on the casing of the electrode. A clamping force is imparted by way of a force-generating mechanism 20 that exerts a radially inwardly directed force ($F_1$) onto the casing of the electrode 11. An equal and opposite force ($F_R$) is exerted by the force generating mechanism in a direction opposite the radially inwardly directed force ($F_1$). However, instead of this force being absorbed by a support frame, which is the case in prior art radial force configurations, the force ($F_R$) is used to tension a tensioning member 30 extending about the electrode 11. The system is therefore simpler and more efficient than prior art slipping devices, due to the forces exerted by the force generating mechanism 20 being effectively harnessed. A further novel and inventive aspect of the invention, which is also clearly illustrated in FIG. 1, is that end zones 35 of the tensioning member 30 are offset relative to an axis of the biasing means 21. This angle ($\beta$) is preferably between 35 and 85 degrees, more preferably between 45 and 75 degrees, and most preferably about 60 degrees when in the preloaded "clamped" position. At the most preferred angle of 60 degrees the optimum balance is reached between force magnitude transferred into the tensioning member 30 and the release movement required when de-clamping the clamping device 10. For example, if the force from the biasing means is 220 kN, a force of 220 kN will be exerted on each of the two ends of the tensioning member 30 resulting in an effective clamping force ratio of 1:2 (i.e 220 kN exerted by biasing means: 220 kN+220 kN exerted on the two ends of the tensioning member 30). In this 60 degree configuration $F_1=F_R=F_3=F_4$. Further, if the biasing means is de-clamped (compressed) by only 50 mm then it causes more than 40 mm circumferential release (slack), resulting in a release ratio of almost 1:1. Both the force distribution ratio and the release ratio are of a very desirable order.

When no de-clamping mechanism is needed, the angle may be much larger, and indeed closer to 85 degrees. This will result in a much greater clamping force ratio of >1:5 resulting in requirement for a much smaller spring. In this configuration, minimal to no de-clamping will be possible and slipping would be achieved by each clamping device being designed to hold only part of the electrode weight, but with the two clamping device in combination being able to hold the electrode weight. When the clamping devices are now forcefully displaced up and down relative to one another, the electrode's mass becomes the determining factor as to which clamp slips over the electrode and in order to result in downward slipping only. This method of slipping is not new but the method of applying the clamping force is.

Figure 2:
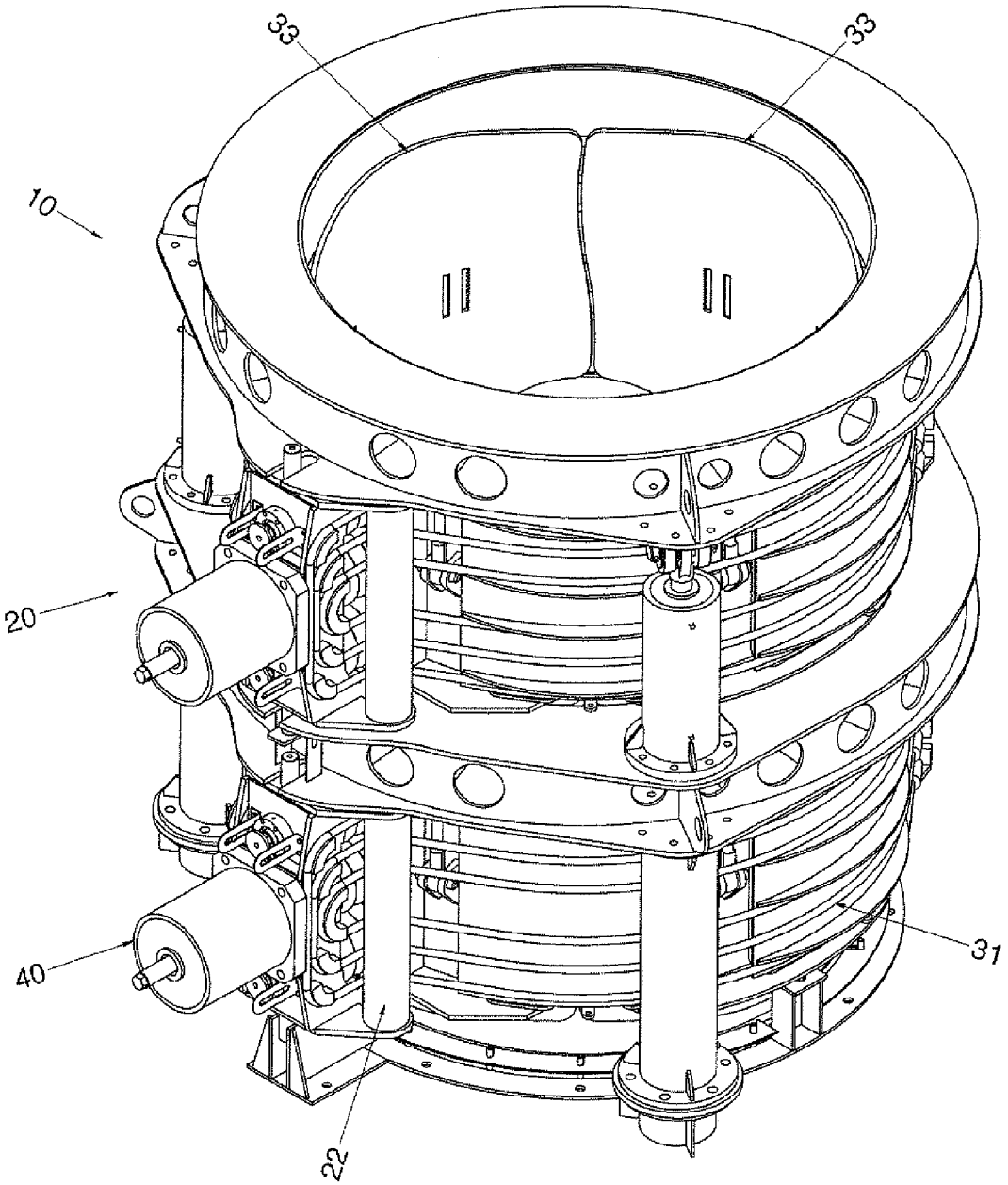
FIG. 2 is a perspective view of two clamping devices in accordance with an embodiment of the invention, with one of the clamping devices located above the other clamping device so as to define an electrode slipping device.
Figure 3:
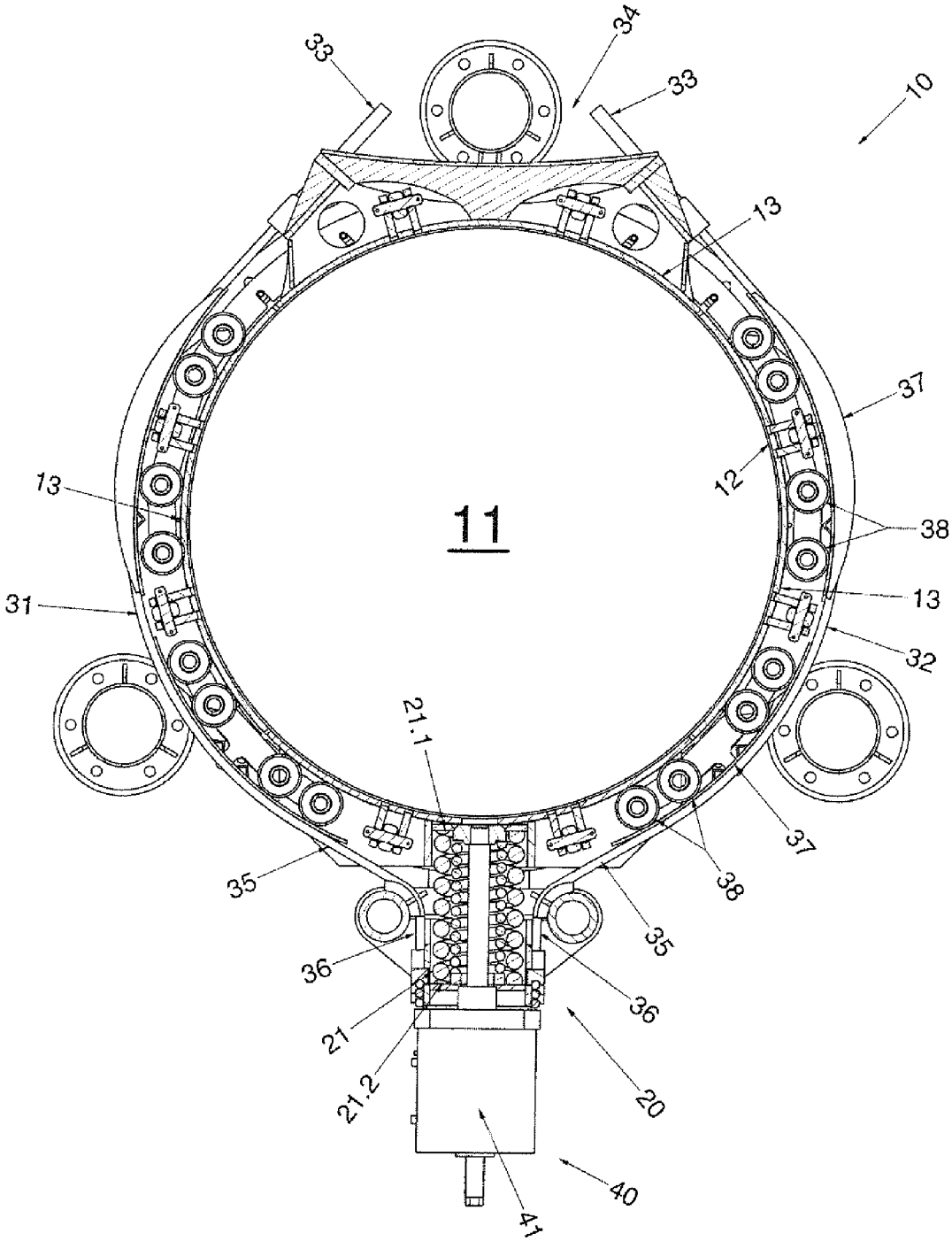
FIG. 3 is a cross-sectional plan view of a clamping device of FIG. 2.
Figure 4:
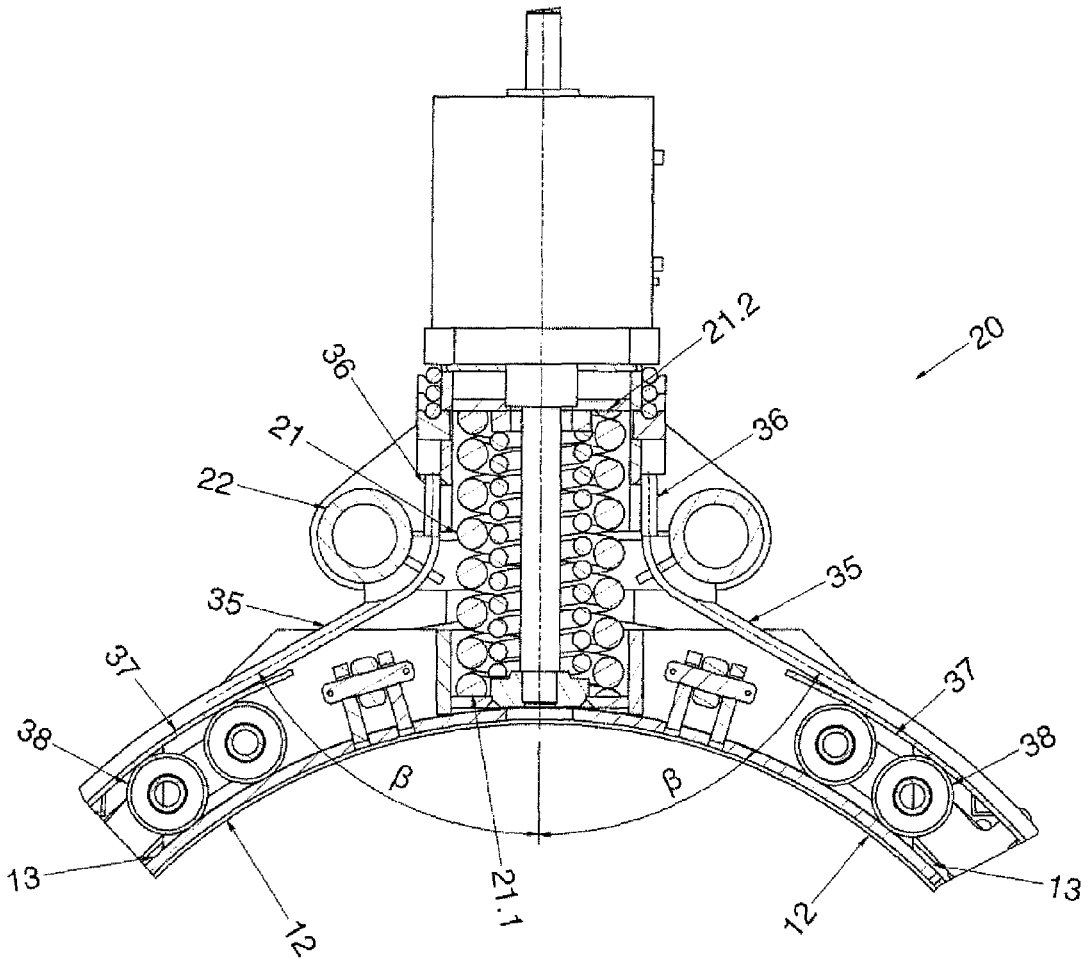
FIG. 4 is an enlarged view of the tensioning mechanism of the clamping device of FIG. 3.

A more specific example of an embodiment of the invention which utilizes the above novel and inventive aspects is now described with reference to FIGS. 2 to 4, in which two clamping devices 10 are used as a set of clamping devices which in use act as an electrode slipping device that is adapted to allow controlled displacement of an electrode 11 in a downward direction (referred to as slipping) or an upward direction (referred to as back-slipping). This is achieved by the clamping devices 10 selectively engaging and disengaging sides of a casing 12 of the electrode 11. The clamping devices 10 are displaceable relative to one another, which therefore allow the electrode to be displaced in a controlled manner. Even though the device is referred to as a slipping device, the clamping devices do not allow the electrode to slip relative to an engaged clamping device. The concept of a slipping device is well known in the art, and this invention relates to the novel and inventive design of a new clamping device for use in a slipping device.

Each clamping device 10 includes a clamping arrangement comprising of friction shoes 13 which can in use be pressed against the electrode casing 12 using a force generating mechanism 20, and which can be relaxed using a de-clamping mechanism 40.

The clamping/tension arrangement can take many different forms, and in this particular example is in the form of two opposing sets of tension elements, in this example being cables 31 & 32. The tension elements (31 and 32) in use at least partially surround the electrode casing 12 in order to form a loop about the electrode casing 12. This loop can be tensioned by means of force generating mechanism 20, and in turn exerts a compressive force onto the friction shoes 13 and in turn onto electrode 11. Each set of clamping elements include a number of spaced apart clamping cables, and the number of cables making up a set is not of a limiting nature insofar as the invention is concerned. For the purposes of clarity reference will be made to a first and second tension element 30 in the singular form, although it will be appreciated that each tension element may in fact comprise a number of individual tension elements as in FIGS. 2 to 4 represented by items 31 and 32.

The tension elements (31 and 32) each have a first end 33 and a second end 35. The first ends 33 of the clamping elements (31 and 32) are connected to an adjustment arrangement 34 which can be adjusted in order to adjust the effective length of the loop formed by the clamping elements (31 and 32). The adjustment arrangement may take many different forms, and in this example is in the form of a friction shoe frame 34 to which the first ends 33 are secured. The first ends 33 are displaceable relative to the friction shoe frame 34, and can also be secured in a required position relative to the frame. It will be appreciated that the adjusting arrangement 34 is not essential, and will be omitted in cases where a single continuous tension element is used instead of two discrete, opposing tension elements (31 and 32).

Second ends 35 of the tension elements (31 and 32) are located diametrically opposite the first ends 33, and are secured to a force generating mechanism 20 which is described in more detail below. The proximal zones of the tension elements (31 and 32) do not directly abut the outer surface 12 of the electrode 11, but runs over force distribution plates 37 which in turn impart the clamping force onto friction shoes 13. The friction shoes 13 are located adjacent the outer surface of electrode casing 12, and in use exerts the clamping force onto the electrode casing. Displacement means, for example rollers 38, are located between the friction shoes 13 and the force distribution plates 37, and allow for some relative sideways movement between the force distribution plates 37 and the friction shoes 13 when the tension arrangement 20 is tensioned or slackened. It is foreseen that the clamping device 10 may be used without tension elements 31 & 32 going all the way around the electrode, in which case the friction shoes will be pivotally linked to each other. More particularly, the tension elements (31 and 32) will include at least some linked sections, with the linked sections defining some of the friction shoes 13.

The force generating mechanism 20 is located diametrically opposite to the adjusting arrangement 34, and includes tensioning means 21 for use in tensioning the clamping arrangement 10, and in this case therefore the opposing clamping elements (31 and 32). The tensioning means 21 is in the form of at least one spring 21 which is displaceable between a compressed position and an extended position, with the spring being biased towards the relaxed, extended position. A first end 21.1 of the spring is in use located adjacent the electrode 11, and the second end 21.2 of the spring is located radially outwardly of the first end 21.1. The spring is therefore orientated in a radial or near radial direction relative to the electrode 11, which is an important feature of the clamping device in accordance with this invention.

As mentioned above, the first end 21.1 of the spring 21 is located adjacent the electrode, and will in use abut the friction shoe 13 that is in contact with the electrode casing 12. When the spring is tensioned, it will therefore exert a radially inwardly directed force onto the electrode, similar to that found in existing radial clamping devices. However, only one tensioning mechanism 20 need be provided, which is a significant departure from the existing radial clamping devices where multiple tensioning means are provided about the periphery of the electrode. In these existing systems, the second end of the tensioning means 21 or spring abuts an external frame, which then absorbs the reaction force of the spring. However, in this case the second end 21.2 of the spring is utilized to exert a further clamping force on the electrode, and no external frame is required. More particularly, the second ends 35 of the tension elements (31 and 32) are secured to the second end 21.2 of the spring, and the reaction force exerted by the spring is exerted onto the tension elements (31 and 32) instead of an external support frame. In this way one end of the spring exerts a radially directed force onto the electrode, while a second end of the spring is used to tension the tension elements, which in turn exerts clamping forces around the electrode. The tensioning means or spring 21 is therefore utilized in a very efficient manner without the need for additional external frames, leavers or supporting structures.

The interface between the tension elements (31 and 32) and the force generating mechanism 20 is also an important aspect of this invention. End zones 35 of the tension elements (31 and 32) are secured relative to the tensioning means or helical coil spring 21 of the force generating mechanism 20. The end zones 35 are angularly offset relative to the longitudinal axis of the spring, and this is in this example achieved by the tension elements (32 and 32) running over guide formations 22 forming part of the frame that houses the 21.2 end of the biasing means. A preferred offset angle (β) between the end zones 35 and longitudinal axis of the biasing means is about 60 degrees. The angular offset β is important because it results in an optimal force distribution in the tension elements (31 and 32) whilst still not allowing an adequate amount of travel of the tensioning means 21 when the clamping device is de-clamped.

The de-clamping mechanism 40 is located adjacent the force generating mechanism 20, and includes a piston and cylinder arrangement 41 that in use compresses the spring 21 when the clamping device is to be de-clamped by introducing slack in the tension elements (31 and 32). The de-clamping mechanism 40 can also be used to pre-stress the spring 21 during installation of the clamping device, which simplifies the setup process.

The combination of a radial and circumferential clamping methodology results in a number of advantages, including:

- The use of only one set of tensioning means or springs;
- Significant reduction in the size and weight of such tensioning means or springs due to the optimal distribution of forces;
- Small amount of travel required during de-clamping;
- By changing the angle of the tensioning means a greatly increased force can be generated for use on heavier solid electrodes requiring less de-clamping
- No requirement for external support frames to counteract the forces exerted by the tensioning means or springs due to the reaction force being exerted directly onto the tension elements.

It will be appreciated that the above is only one embodiment of the invention and that there may be many variations without departing from the spirit and/or the scope of the invention.

The invention claimed is:

1. A clamping device, suitable for clamping and holding an electrode of an arc furnace, the clamping device comprising:

at least one elongate tension element configured to extend at least partially about a periphery of the electrode of the arc furnace in order for the at least one tension element to define a tensionable loop about the electrode that is adapted to exert a clamping force on the electrode when tensioned; and at least one biasing means having a first end and a second end, wherein the second end is configured to be located radially or near radially outwardly of the first end relative to the electrode, wherein the at least one biasing means is displaceable between an extended position and a compressed position, with the at least one biasing means being biased towards the extended position;

a securing structure secured to end zones of the at least one tension element and also secured to the second end of the at least one biasing means, such that displacement of the at least one biasing means from the compressed position to the extended position is configured to cause displacement of the second end of the at least one biasing means radially or near radially outwardly away from the first end is configured to result in tensioning of the at least one tension element, and wherein displacement of the at least one biasing means from the compressed position to the extended position is configured to cause the first end of the at least one biasing means to exert a radial or near radial force directed towards the electrode and to cause the second end of the at least one biasing means to exert a radial or near radial reactive force directed away from the electrode, and wherein the securing structure being secured to the end zones of the at least one tension element and the second end of the at least one biasing means is configured to cause the reactive force directed away from the electrode to be taken up and distributed around the electrode by the tensioning of the at least one tension element.

2. The clamping device of claim 1 in which the end zones of the tension element are angularly offset at an offset angle relative to a longitudinal axis of the at least one biasing means.

3. The clamping device of claim 2 in which the offset angle is between 35 and 85 degrees.

4. The clamping device of claim 2 in which the offset angle is between 45 and 75 degrees.

5. The clamping device of claim 2 in which the offset angle is approximately 60 degrees when in a preloaded position.

6. The clamping device of claim 1 in which the at least one biasing means comprises a spring which is displaceable between the extended position and the compressed position, with the spring being biased towards the extended position, wherein the first end of the spring is configured to be located adjacent the electrode.

7. The clamping device of claim 1 further comprising friction shoes, which are configured to be located between the at least one tension element and a casing surface of the electrode.

8. The clamping device of claim 1 in which the at least one tension element is integrated into a friction shoe to form one integral part that is pivotally linked to additional similar shoe or shoes.

9. The clamping device of claim 1 further comprising a de-clamping mechanism for use in reducing the tension in the clamping device in order to release the electrode when clamped.

10. The clamping device of claim 9 in which the de-clamping mechanism includes a piston and cylinder arrangement which is configured to compress the at least one biasing means when actuated.

11. The clamping device of claim 1 wherein the at least one biasing means comprises at least one spring.

12. The clamping device of claim 1 wherein the at least one biasing means comprises at least one actuator.

* * * * *